US012503804B2

(12) United States Patent
Kang et al.

(10) Patent No.: US 12,503,804 B2
(45) Date of Patent: Dec. 23, 2025

(54) DRIVE SYSTEM OF A WASHING MACHINE AND A WASHING MACHINE WITH THE SAME

(71) Applicant: LG Electronics Inc., Seoul (KR)

(72) Inventors: Joohang Kang, Seoul (KR); Youngchan Ahn, Seoul (KR); Junggu Lee, Seoul (KR); Yongsik Park, Seoul (KR)

(73) Assignee: LG Electronics Inc., Seoul (KR)

( * ) Notice: Subject to any disclaimer, the term of this patent is extended or adjusted under 35 U.S.C. 154(b) by 165 days.

(21) Appl. No.: 18/243,875

(22) Filed: Sep. 8, 2023

(65) Prior Publication Data

US 2024/0133105 A1 Apr. 25, 2024
US 2024/0229326 A9 Jul. 11, 2024

(30) Foreign Application Priority Data

Oct. 21, 2022 (KR) ..... 10-2022-0136413

(51) Int. Cl.
*D06F 37/30* (2020.01)
*D06F 37/40* (2006.01)

(52) U.S. Cl.
CPC ..... *D06F 37/304* (2013.01); *D06F 37/40* (2013.01)

(58) Field of Classification Search
CPC ..... D06F 37/304; D06F 37/40
See application file for complete search history.

(56) References Cited

U.S. PATENT DOCUMENTS

2014/0323264 A1* 10/2014 Yeh ..... F16H 1/28 475/341
2017/0247828 A1* 8/2017 Tsuji ..... D06F 37/065
2017/0284007 A1* 10/2017 Hirota ..... D06F 23/02
2018/0347096 A1* 12/2018 Yoneda ..... D06F 23/06
2018/0347097 A1* 12/2018 Yoneda ..... D06F 34/08
2018/0371670 A1* 12/2018 Tanikoshi ..... D06F 37/304
2019/0017211 A1 1/2019 Kim et al.
2019/0249351 A1 8/2019 Jackson
2020/0131686 A1 4/2020 Lee et al.
2020/0232143 A1* 7/2020 Sonoda ..... D06F 33/00

FOREIGN PATENT DOCUMENTS

KR 10-1920812 11/2018
KR 10-2020-0089604 7/2020
KR 111793935 10/2020

OTHER PUBLICATIONS

Machine translation of CN 111793935 A to Liu. (Year: 2020).*
Extended European Search Report in European Appln. No. 23196145.9, mailed on Mar. 4, 2024, 10 pages.

* cited by examiner

*Primary Examiner* — Joseph L. Perrin
(74) *Attorney, Agent, or Firm* — Fish & Richardson P.C.

(57) ABSTRACT

A drive system of a washing machine includes a rotor shaft and an output shaft; an n:1 stage positioned on the rotor shaft; a 1:1 stage positioned behind the n:1 stage, coupled to the rotor shaft and integrally rotating with the rotor shaft; a planetary gear set including a ring gear shaft surrounding a part of a circumference of the rotor shaft, and transmitting a rotational force of the rotor shaft to the output shaft at a ratio of 1:1 or by reducing at a gear ratio of n:1; a dynamic clutch coupled to the ring gear shaft between the n:1 stage and the 1:1 stage, moving in an axial direction on the ring gear shaft, and integrally rotating with the ring gear shaft; and a clutch driving portion for moving the dynamic clutch in the axial direction.

17 Claims, 13 Drawing Sheets

DRIVE SYSTEM OF A WASHING MACHINE AND A WASHING MACHINE WITH THE SAME

CROSS-REFERENCE TO RELATED APPLICATION

This application claims priority to and the benefit of Korean Patent Application No. 10-2022-0136413, filed in the Korean Intellectual Property Office on Oct. 21, 2022.

TECHNICAL FIELD

The present disclosure relates to a drive system of a washing machine and a washing machine with the same, and more specifically, to a drive system of a washing machine with a mechanically operated dynamic clutch and a washing machine with the same.

BACKGROUND

The washing machine is driven in two main operating modes (washing mode and spin-drying mode) with different operating conditions.

Therefore, in order to satisfy both of the above two main operating modes, the washing machine is provided with a planetary gear set and a clutch, and operates an output shaft at low speed and high torque with a gear ratio of n:1 (washing mode), or operates the output shaft at high speed and low torque with a gear ratio of 1:1 (spin-drying mode).

Here, the output shaft refers to a shaft coupled to a drum to rotate a washing tub (drum or inner tub).

That is, in a normal washing machine, after the washing mode (which may include a rinsing mode) ends, the motor is temporarily stopped, and a draining operation is performed. And, after the draining operation ends, a spin-drying initial mode starts.

However, since a high torque is required to initially start wet laundry in the spin-drying initial mode, the output shaft must be operated at a low speed and high torque.

In addition, in order to start the spin-drying mode after the spin-drying initial mode is completed, the output shaft must be operated at high speed and low torque.

Therefore, the drive system of the washing machine includes parts for shifting a rotational force of the rotor shaft transmitted to the output shaft between the spin-drying initial mode and the spin-drying mode, for example, a planetary gear set and a clutch.

Related art discloses a structure for changing a gear ratio by installing a planetary gear set including carriers, sun gears, a plurality of satellite gears, internal gears, etc. in a rotor case and changing the position of the internal gear by a solenoid clutch.

That is, the washing machine is operated at low speed and high torque by allowing the internal gear to be supported by the stator through the slider of the solenoid clutch in the spin-drying initial mode, and by allowing rotations of the rotor shaft and the sun gear to be transmitted to the output shaft through the planetary gear set.

In addition, the washing machine is operated at high speed and low torque by allowing the internal gear to be supported on the rotor shaft through the slider of the solenoid clutch in the spin-drying mode, and by allowing rotations of the rotor shaft and the sun gear to be transmitted to the output shaft without going through the planetary gear set.

However, according to the above drive system, it is impossible to adjust the exact neutral position of the solenoid clutch.

Therefore, the drive system in the related art may drive the washing machine only in the spin-drying initial mode and the spin-drying mode, and cannot separately form a synchronization mode for synchronizing the rotational speed of the output shaft with the rotational speed of the rotor shaft between the spin-drying initial mode and the spin-drying mode.

Since a larger coil is required to obtain sufficient electromagnetic force to move the solenoid clutch, there is a problem in that the weight and volume of the solenoid clutch increases.

In addition, since the solenoid clutch is positioned behind the rotor and the stator, it is disadvantageous to secure the volume of the washing machine, and in order to apply power to the solenoid clutch, a separate circuit must be configured and wired between the rotor and the stator, so that there are problems such as difficult wiring work.

Other related art discloses a structure for changing a gear ratio while moving the position of a deceleration coupling unit including the planetary gear set forward and backward using a lever.

That is, in this case, in the spin-drying initial mode, the deceleration coupling unit is moved forward according to the operation of the lever of the lever unit, and accordingly, teeth formed on the coupling cap of the deceleration coupling unit are engaged with teeth formed on the washing tub (drum or inner tub), so that the washing machine is operated at low speed and high torque.

In the spin-drying mode, the deceleration coupling unit is moved backward according to the operation of the lever of the lever unit, and accordingly, teeth formed on the coupling housing of the deceleration coupling unit are engaged with teeth formed on the rotor housing, so that the washing machine is operated at high speed and low torque.

However, according to the drive system disclosed above, since the pinion gear provided in the carrier of the deceleration coupling unit must move in the axial direction with respect to the sun gear, only the spur gear, not helical gears, can be used as the pinion gear and the sun gear, and there is a problem in that noise is generated due to this.

In addition, since the forward and backward movement of the deceleration coupling unit is possible only while the motor is stopped, there is a problem in that the motor must be stopped for mode conversion.

In addition, the sun gear provided in the planetary gear set is mounted on a bearing on the output shaft, and the output shaft is supported by only one bearing.

Therefore, in the spin-drying initial mode, the planetary gear set serves as a support point, so that the output shaft is supported by the planetary gear set and the bearing, but in the spin-drying mode, since the rotor, the planetary gear set, and the output shaft operate as one, and the output shaft is supported by only one bearing, there is a problem of low durability in the spin-drying mode operating at high speed and low torque.

Other related art discloses a structure that couples a prime mover to the input shaft of a motor by a spline coupling, forms a first coupling state by moving the prime mover in the axial direction of the input shaft and coupling it to the sun gear, forms a second coupling state by moving the prime mover in the axial direction opposite to the input shaft and coupling it to the carrier, and synchronizes the speed using a synchronizer when shifting.

However, the related arts described above do not suggest any technical solutions to increase motor efficiency when operating the washing machine in the spin-drying initial mode and in the spin-drying mode, that is, in the low speed and high speed operation.

SUMMARY

A technical problem to be solved by the present disclosure is to provide a drive system of a washing machine equipped with a dynamic clutch capable of effectively synchronizing a rotational speed of an output shaft and a rotor shaft by implementing synchronization mode between a spin-drying initial mode in which the output shaft rotates at low speed and high torque and a spin-drying mode in which the output shaft rotates at high speed and low torque.

Another technical problem to be solved by the present disclosure is to provide a drive system of a washing machine capable of downsizing of motors and motor driving circuits since high torque is not required in the spin-drying initial mode.

Still another technical problem to be solved by the present disclosure is to provide a drive system of a washing machine capable of reducing shift noise and shift shock generated when shifting from the spin-drying initial mode to the spin-drying mode.

Still another technical problem to be solved by the present disclosure is to provide a drive system of a washing machine capable of sufficiently securing the axial force required to move the dynamic clutch even with a small-sized actuator.

Still another technical problem to be solved by the present disclosure is to provide a drive system of a washing machine capable of being easy to wire the actuator for moving the dynamic clutch in the axial direction.

Still another technical problem to be solved by the present disclosure is to provide a drive system of a washing machine capable of advantageously securing the volume of the washing machine.

Still another technical problem to be solved by the present disclosure is to provide a drive system of a washing machine capable of increasing the wear safety factor of the dynamic clutch and the safety factor of gears provided in a planetary gear set.

Still another technical problem to be solved by the present disclosure is to provide a drive system of a washing machine capable of improving durability and noise performance and increasing driving efficiency.

Still another technical problem to be solved by the present disclosure is to provide a front-loading type washing machine having a drive system of a washing machine including a dynamic clutch.

The technical problems to be achieved from the present disclosure are not limited to the technical problems mentioned above, and other technical problem which are not mentioned above can be clearly understood from the following description by those skilled in the art to which the present disclosure pertains.

A drive system of a washing machine according to an embodiment of the present disclosure may comprises may include a rotor shaft and an output shaft positioned apart from each other; a planetary gear set including a ring gear shaft surrounding a part of a circumference of the rotor shaft, and transmitting a rotational force of the rotor shaft to the output shaft at a ratio of 1:1 or by reducing at a gear ratio of n:1; and a dynamic clutch coupled to the ring gear shaft, moving in an axial direction on the ring gear shaft, and integrally rotating with the ring gear shaft.

The drive system of the washing machine may further include a clutch driving portion for moving the dynamic clutch in the axial direction.

The drive system of the washing machine may further include an n:1 stage positioned on the rotor shaft in front of the dynamic clutch and coupled to the dynamic clutch so that the rotational force of the rotor shaft is reduced and transmitted to the output shaft at a gear ratio of n:1 in a spin-drying initial mode; and a 1:1 stage positioned behind the dynamic clutch, coupled to the rotor shaft and integrally rotating with the rotor shaft, and coupled to the dynamic clutch so that the rotational force of the rotor shaft is transmitted to the output shaft at a gear ratio of 1:1 in a spin-drying mode.

The drive system of the washing machine of this configuration may implement between the spin-drying initial mode and the spin-drying mode, by separating the dynamic clutch from the n:1 stage and the 1:1 stage, respectively, and by positioning the dynamic clutch at a neutral stage, a synchronization mode in which a rotational speed of the rotor shaft is synchronized with a rotational speed of the output shaft by the planetary gear set.

According to this configuration, since a synchronization mode is performed at an exact position between the spin-drying initial mode in which the output shaft rotates at low speed and high torque and the spin-drying mode in which the output shaft rotates at high speed and low torque to provide a dynamic clutch that can effectively synchronize the rotational speeds of the output shaft and rotor shaft, it is possible to change from the spin-drying initial mode to the spin-drying mode through the synchronization mode even while the motor is rotating.

Accordingly, downsizing of the motor and motor driving circuit is possible.

In particular, since in a top-loading washing machine in which a washing tub (drum or inner tub) is disposed in an upright state, for example, a "pulsator washing machine", the laundry is placed flat on the bottom of the washing tub (drum or inner tub), the starting torque at spin-drying is smaller than that of the front-loading washing machine.

However, since in a front-loading washing machine in which a washing tub (drum or inner tub) is disposed in a horizontal direction, for example, a "drum washing machine", laundry is disposed on the bottom of the wall of the washing tub (drum or inner tub), not on the bottom of the washing tub (drum or inner tub), the starting torque during spin-drying is higher than that of top-loading washing machines.

Therefore, an intelligent power module (IMP) of an inverter provided in the front-loading pulsator washing machine must use a product having a larger capacity than that of an intelligent power module (IMP) of an inverter provided in the top-loading drum washing machine.

For example, it is possible to use an intelligent power module having a capacity of 5 A in a top-loading pulsator washing machine, but an intelligent power module having a capacity of 15 A must be used in a front-loading drum washing machine.

In general, the current value (Apk) at the peak of an intelligent power module having a capacity of 5 A is 3 Apk, and the current value at the peak of an intelligent power module having a capacity of 15 A is 9 to 11 Apk.

In addition, a conventional front-loading type drum washing machine without a clutch had to have a motor having a large capacity to rotate the drum at different rotational speeds during washing and spin-drying.

However, when the washing machine drive system according to the present disclosure is applied to a front-loading type drum washing machine, it is possible to reduce starting torque during washing and spin-drying operations compared to conventional front-loading type drum washing machines not equipped with the washing machine drive system according to the present disclosure.

Therefore, the front-loading type drum washing machine equipped with the washing machine drive system according to the present disclosure can use an intelligent power module with a smaller capacity than a conventional front-loading type drum washing machine.

For example, it is possible to use an intelligent power module having a capacity of 5 A in a front-loading drum washing machine equipped with a washing machine drive system according to the present disclosure.

Therefore, since it is possible to use an inexpensive intelligent power module having a small capacity, the manufacturing cost of the washing machine can be reduced.

Also, since there is no need to use a motor with a large capacity, downsizing of the motor is possible.

In addition, it is possible to reduce shift noise and shift shock generated when shifting from the spin-drying initial mode to the spin-drying mode.

The output shaft may rotate while maintaining a constant speed in the spin-drying initial mode, the synchronization mode, and the spin-drying mode.

In the spin-drying initial mode, the rotational speed of the rotor shaft may increase until reaching a first rotational speed, the output shaft may maintain a second rotational speed lower than the first rotational speed, and the dynamic clutch may be maintained in a stationary state.

In the synchronization mode, the rotational speed of the rotor shaft may be reduced from the first rotational speed to the second rotational speed, the output shaft may maintain the second rotational speed, and a rotational speed of the dynamic clutch may increase until reaching the second rotational speed.

In the spin-drying mode, the rotational speed of the rotor shaft, the rotational speed of the output shaft, and the rotational speed of the dynamic clutch may be maintained at the second speed, respectively.

The ring gear shaft may include a shaft portion surrounding the part of the circumference of the rotor shaft, and a plate portion positioned at a front end of the shaft portion.

Spline coupling portions coupled to each other may be formed on an outer circumferential surface of the shaft portion and an inner circumferential surface of the dynamic clutch, respectively.

According to this configuration, the spin-drying initial mode/synchronization mode/spin-drying mode can be selectively performed by adjusting whether or not the ring gear shaft to which the dynamic clutch is coupled is rotated.

In addition, the rotational force of the dynamic clutch can be effectively transmitted to the ring gear shaft (in the spin-drying mode), and the rotational force of the ring gear shaft can be effectively transmitted to the dynamic clutch (in the synchronization mode).

The planetary gear set may include a sun gear, a gear cover, a ring gear, a plurality of pinion gears, and a carrier.

The sun gear may be positioned on a part of an outer circumferential surface of the rotor shaft in front of the plate portion of the ring gear shaft.

The gear cover may be coupled to the plate portion of the ring gear shaft and may accommodate the sun gear therein.

The ring gear may be disposed in an inner space formed by the gear cover and the plate portion of the ring gear shaft, may be coupled to the plate portion of the ring gear shaft to rotate integrally with the ring gear shaft.

The plurality of pinion gears may be disposed between the ring gear and the sun gear in the inner space formed by the gear cover and the plate portion of the ring gear shaft.

The carrier may be disposed in the inner space formed by the gear cover and the plate portion of the ring gear shaft to support the plurality of pinion gears, and may rotate integrally with the output shaft by being one end of which coupled to the output shaft.

The sun gear, the ring gear, and the plurality of pinion gears each may include a helical gear.

According to this configuration, it is possible to increase the safety factor of the gears provided in the planetary gear set, and reduce the noise generated during gear rotation.

The output shaft may include an inner shaft to which the carrier is coupled, and an outer shaft positioned outside the inner shaft and coupled to the gear cover.

The spline coupling portions coupled to each other may be formed on an outer circumferential surface of the inner shaft and an inner circumferential surface of the carrier, respectively.

A part of the carrier may be inserted into a space between the inner shaft and the outer shaft.

According to this configuration, the rotational force of the carrier may be accurately transmitted to the output shaft.

The drive system of the washing machine may further include a casing accommodating the planetary gear set therein and including a first case and a second case.

A rear end of the output shaft may be inserted through the first case, and a front end of the rotor shaft may be inserted through the second case.

A first bearing supporting the output shaft may be positioned between the outer shaft and the first case, and a second bearing supporting the rotor shaft may be positioned between the shaft portion of the ring gear shaft and the second case.

According to this configuration, it is possible to effectively support the rotating shafts (rotor shaft and output shaft) in the spin-drying initial mode/synchronization mode/spin-drying mode.

In the spin-drying initial mode, the n:1 stage, the dynamic clutch coupled to the n:1 stage, the ring gear shaft coupled to the dynamic clutch, and the ring gear coupled to the plate portion of the ring gear shaft may be maintained in a stationary state.

And in the spin-drying initial mode, the rotational force of the rotor shaft may be sequentially transmitted to the output shaft through the sun gear coupled to the rotor shaft, the plurality of pinion gears coupled to the sun gear, and the carrier supporting the plurality of pinion gears.

In the synchronization mode, the n:1 stage, the 1:1 stage, the dynamic clutch, the ring gear shaft coupled to the dynamic clutch, and the ring gear coupled to the plate portion of the ring gear shaft may be maintained in a stationary state.

In the synchronization mode, the rotational force of the rotor shaft may be sequentially transmitted to the output shaft through the sun gear coupled to the rotor shaft, the plurality of pinion gears coupled to the sun gear, and the carrier supporting the plurality of pinion gears.

In the synchronization mode, the rotational speed of the dynamic clutch may be synchronized with the rotational speed of the rotor shaft by increasing by the plurality of pinion gears each rotating and revolving.

In the spin-drying mode, the 1:1 stage and the dynamic clutch coupled to the 1:1 stage may rotate integrally with the rotor shaft.

In the spin-drying mode, the rotational force of the rotor shaft may be transmitted to the output shaft through the planetary gear set rotating entirely around the rotor shaft.

The dynamic clutch may include a first clutch portion facing the n:1 stage and a second clutch portion facing the 1:1 stage.

A plurality of first gears formed in a quadrangular or trapezoidal shape and coupled to each other may be provided on a surface where the first clutch portion and the n:1 stage face each other, respectively.

A plurality of second gears formed in a shape having an inclined surface and a vertical surface and coupled to each other may be provided on a surface where the second clutch portion and the 1:1 stage face each other, respectively.

The second gear of the second clutch portion and the second gear of the 1:1 stage may be coupled to each other in a state in which the rotational speed of the dynamic clutch and the rotational speed of the 1:1 stage are synchronized.

According to this configuration, the wear safety factor of the dynamic clutch may be increased.

The drive system of the washing machine may further include a casing accommodating the planetary gear set therein and including a first case and a second case; and a rear frame fixed to a rear surface of the second case.

The n:1 stage may be coupled to the rear frame outside the casing.

The clutch driving portion may include a fork lever, a connecting rod, and a fork.

The fork lever may be installed through the second case in a vertical direction and may be moved in the vertical direction by an actuator.

The connecting rod may be coupled to the fork lever and may move in a horizontal direction as the fork lever moves in the vertical direction.

One end of the fork may be coupled to the connecting rod, the other end of the fork may be coupled to the dynamic clutch.

The fork may rotate based on a pin coupled to the rear frame to adjust a position of the dynamic clutch when the connecting rod moves in the horizontal direction.

According to this configuration, since the position of the dynamic clutch is adjusted using the fork, a synchronization mode in which speed synchronization is performed between the dynamic clutch and the rotor shaft can be formed at an exact position between the spin-drying initial mode and the spin-drying mode.

Since the fork rotates according to the principle of leverage, the axial force necessary for moving the dynamic clutch can be sufficiently secured even with a small-sized actuator.

The dynamic clutch may further include a connecting portion connecting the first clutch portion and the second clutch portion.

A diameter of the connection portion may be formed to be smaller than diameters of the first clutch portion and the second clutch portion.

The fork may be coupled to the connecting portion of the dynamic clutch.

The drive system of the washing machine may further include a first return spring for returning the fork lever to its original position.

According to this configuration, it is possible to smoothly operate the fork lever.

The fork lever and the connecting rod each may include an inclined portion for allowing the connecting rod to move in the horizontal direction as the fork lever moves in the vertical direction.

According to this configuration, the dynamic clutch can be positioned at an accurate position according to the spin-drying initial mode/synchronization mode/spin-drying mode.

The drive system of the washing machine may further include a second return spring for returning the connecting rod to its original position.

According to this configuration, it is possible to smoothly operate the connecting rod.

A stator may be coupled to the rear frame.

According to this configuration, since the actuator for driving the fork lever is positioned on the front side of the rotor and the stator, the wiring work of the actuator for moving the dynamic clutch in the axial direction can be easily performed.

In addition, since the dynamic clutch is positioned in front of the rotor and the stator, it is possible to advantageously secure the volume of the washing machine.

The drive system of the washing machine having the above configuration may be provided in a front-loading type drum washing machine.

According to this configuration, since it is possible to use an inexpensive intelligent power module having a small capacity, the manufacturing cost of the washing machine can be reduced, and since there is no need to use a large-capacity motor, downsizing of the motor is possible.

In the front-loading type drum washing machine having the drive system of the washing machine according to the present disclosure, the rotor shaft and the output shaft may be positioned to be spaced apart from each other in a horizontal direction.

According to the present disclosure, since a synchronization mode is performed at an exact position between the spin-drying initial mode in which the output shaft rotates at low speed and high torque and the spin-drying mode in which the output shaft rotates at high speed and low torque to provide a dynamic clutch that can effectively synchronize the rotational speeds of the output shaft and rotor shaft, it is possible to change from the spin-drying initial mode to the spin-drying mode even while the motor is rotating.

In addition, since high torque is not required in the spin-drying initial mode, down sizing of the motor and motor driving circuit is possible.

In addition, it is possible to reduce shift noise and shift shock generated when shifting from the spin-drying initial mode to the spin-drying mode.

In addition, it is possible to form a synchronization mode in which speed synchronization is performed between the dynamic clutch and the rotor shaft at an exact position between the spin-drying initial mode and the spin-drying mode.

In addition, it is possible to sufficiently secure the axial force necessary for moving the dynamic clutch even with a small-sized actuator.

In addition, it is possible to easily perform the wiring work of the actuator for moving the dynamic clutch in the axial direction.

In addition, since the dynamic clutch is positioned in front of the rotor and the stator, it is possible to advantageously secure the volume of the washing machine.

In addition, it is possible to increase the wear safety factor of the dynamic clutch and the safety factor of gears provided in the planetary gear set.

In addition, it is possible to improve durability and noise performance of the drive system of the washing machine and increase driving efficiency.

In addition, when the drive system of the washing machine according to the present disclosure is applied to a front-loading type drum washing machine, since it is possible to use an inexpensive intelligent power module having a small capacity, the manufacturing cost of the washing machine can be reduced, and since there is no need to use a motor with a large capacity, downsizing of the motor is possible.

Effects obtainable from the present disclosure are not limited by the effects mentioned above, and other effects which are not mentioned above can be clearly understood from the following description by those skilled in the art to which the present disclosure pertains.

BRIEF DESCRIPTION OF THE DRAWINGS

The accompanying drawings, which are included as a part of the detailed description to help the understanding of the present disclosure, provide embodiments of the present disclosure, and together with the detailed description, describe the technical features of the present disclosure.

DETAILED DESCRIPTION OF THE EMBODIMENTS

Figure 1:
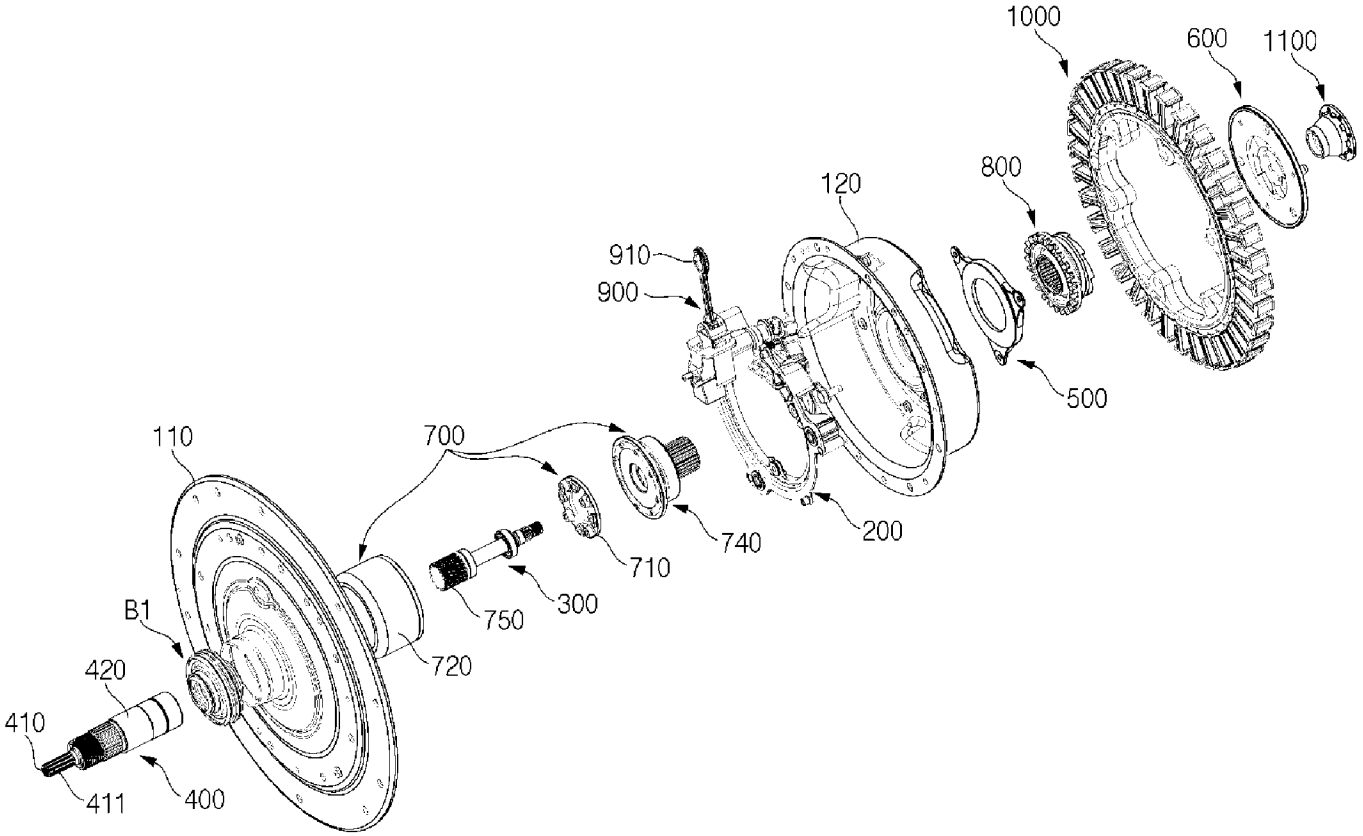
FIG. 1 is a schematic exploded perspective view of a drive system of a washing machine according to an embodiment of the present disclosure.

Hereinafter, embodiments disclosed in the present disclosure will be described in detail with reference to the accompanying drawings, however, regardless of the reference numerals, the same or similar components will be given the same reference numerals and redundant description thereof will be omitted.

The suffixes "assembly" and "unit" for elements used in the following description are given or mixed in consideration of only the ease of writing the specification, and do not have distinct meanings or roles by themselves.

In addition, in describing the embodiments disclosed in the present disclosure, when it is determined that the detailed description of the related known technology may obscure the subject matter of the embodiments disclosed in the present disclosure, the detailed description thereof will be omitted.

In addition, the accompanying drawings are only for easily understanding the embodiments disclosed in the present disclosure, the technical spirit disclosed in the present disclosure is not limited by the accompanying drawings, and it should be understood that the accompanying drawings include all changes, equivalents, and substitutes included in the spirit and scope of the present disclosure.

While terms, such as "first", "second", etc., may be used to describe various elements, such elements must not be limited by the above terms. The above terms are used only to distinguish one element from another.

When an element is referred to as being "coupled" or "connected" to another element, it may be directly coupled to or connected to the other element, however, it should be understood that other elements may exist in the middle.

On the other hand, when an element is referred to as being "directly coupled" or "directly assembled" to another element, it should be understood that there are no other elements in the middle.

The singular forms are intended to include the plural forms as well, unless the context clearly indicates otherwise.

In addition, in the present disclosure, it should be understood that the terms "comprise" and "have" specify the presence of stated features, integers, steps, operations, elements, parts, or combinations thereof, but do not preclude the presence or addition of one or more other features, integers, steps, operations, elements, parts, or combinations thereof.

Hereinafter, a preferred embodiment according to the present disclosure will be described in detail with reference to the accompanying drawings, however, regardless of the reference numerals, the same or similar elements will be given the same reference numerals and redundant description thereof will be omitted.

FIG. 1 is a schematic exploded perspective view of a drive system of a washing machine according to an embodiment of the present disclosure.

Figure 2:
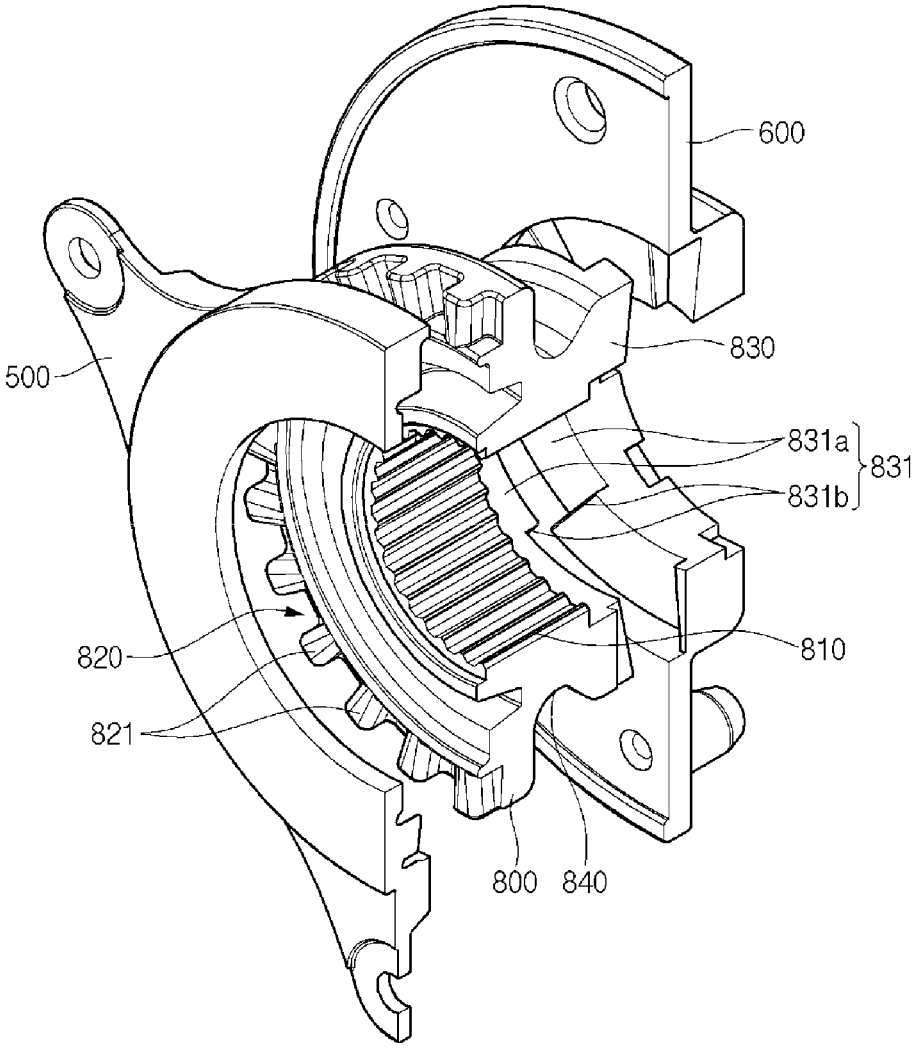
FIG. 2 is a front side cross-sectional perspective view showing an disassembled state of an n:1 stage, a dynamic clutch, and a 1:1 stage in a drive system of a washing machine according to an embodiment of the present disclosure.

FIG. 2 is a front side cross-sectional perspective view showing an disassembled state of an n:1 stage, a dynamic clutch, and a 1:1 stage in a drive system of a washing machine according to an embodiment of the present disclosure.

Figure 3:
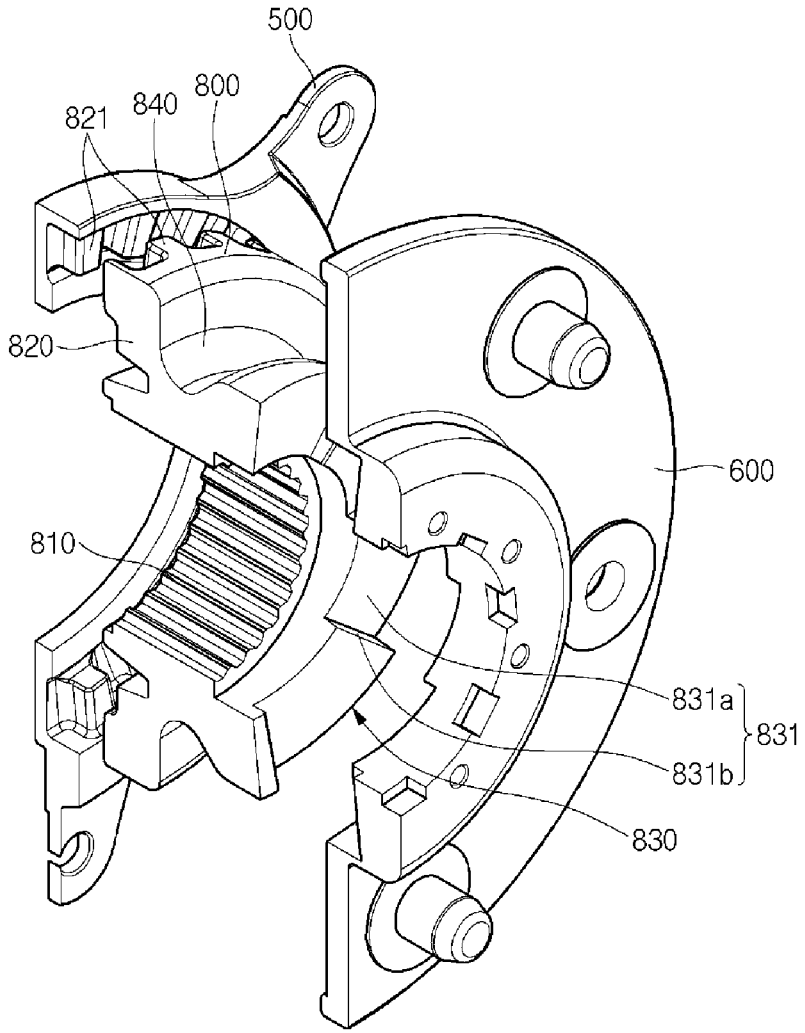
FIG. 3 is a rear side cross-sectional perspective view showing a disassembled state of an n:1 stage, a dynamic clutch, and of a 1:1 stage in a drive system of a washing machine according to an embodiment of the present disclosure.

FIG. 3 is a rear side cross-sectional perspective view showing a disassembled state of an n:1 stage, a dynamic clutch, and of a 1:1 stage in a drive system of a washing machine according to an embodiment of the present disclosure.

Figure 4:
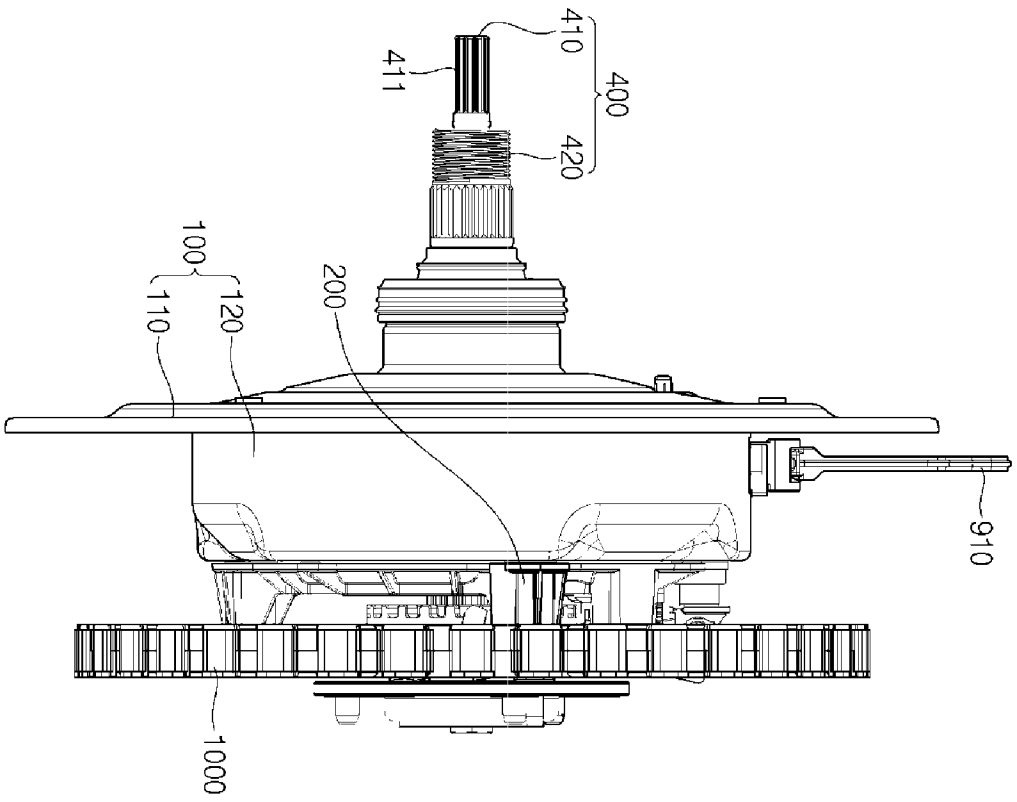
FIG. 4 is a side view showing an assembled state of a drive system of a washing machine according to an embodiment of the present disclosure.

FIG. 4 is a side view showing an assembled state of a drive system of a washing machine according to an embodiment of the present disclosure.

Figure 5:
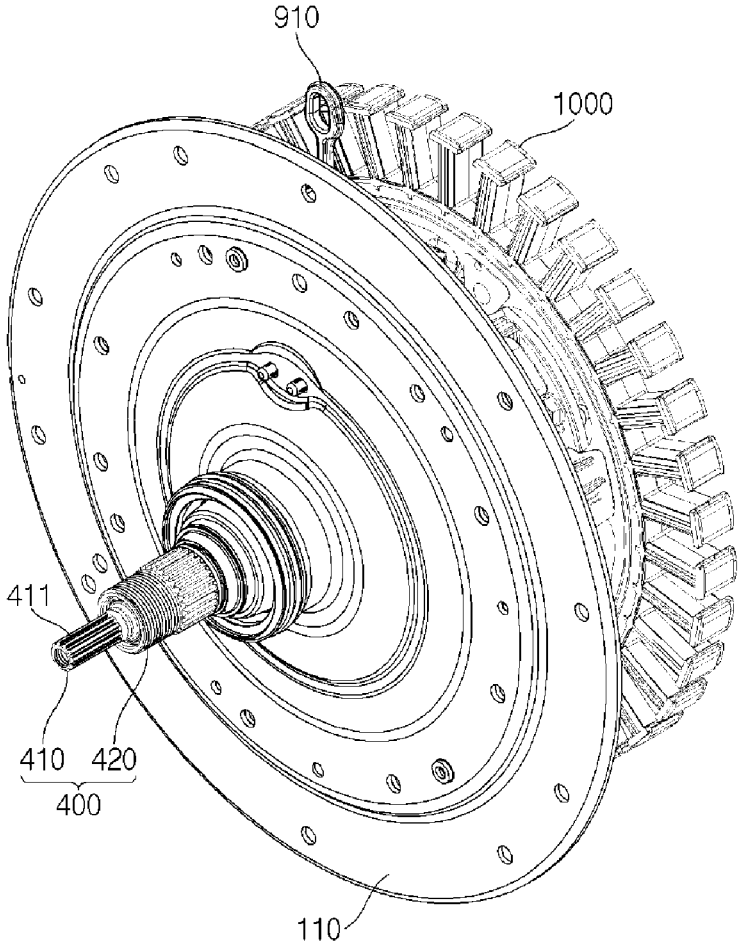
FIG. 5 is a front side perspective view showing an assembled state of a drive system of a washing machine according to an embodiment of the present disclosure.

FIG. 5 is a front side perspective view showing an assembled state of a drive system of a washing machine according to an embodiment of the present disclosure.

Figure 6:
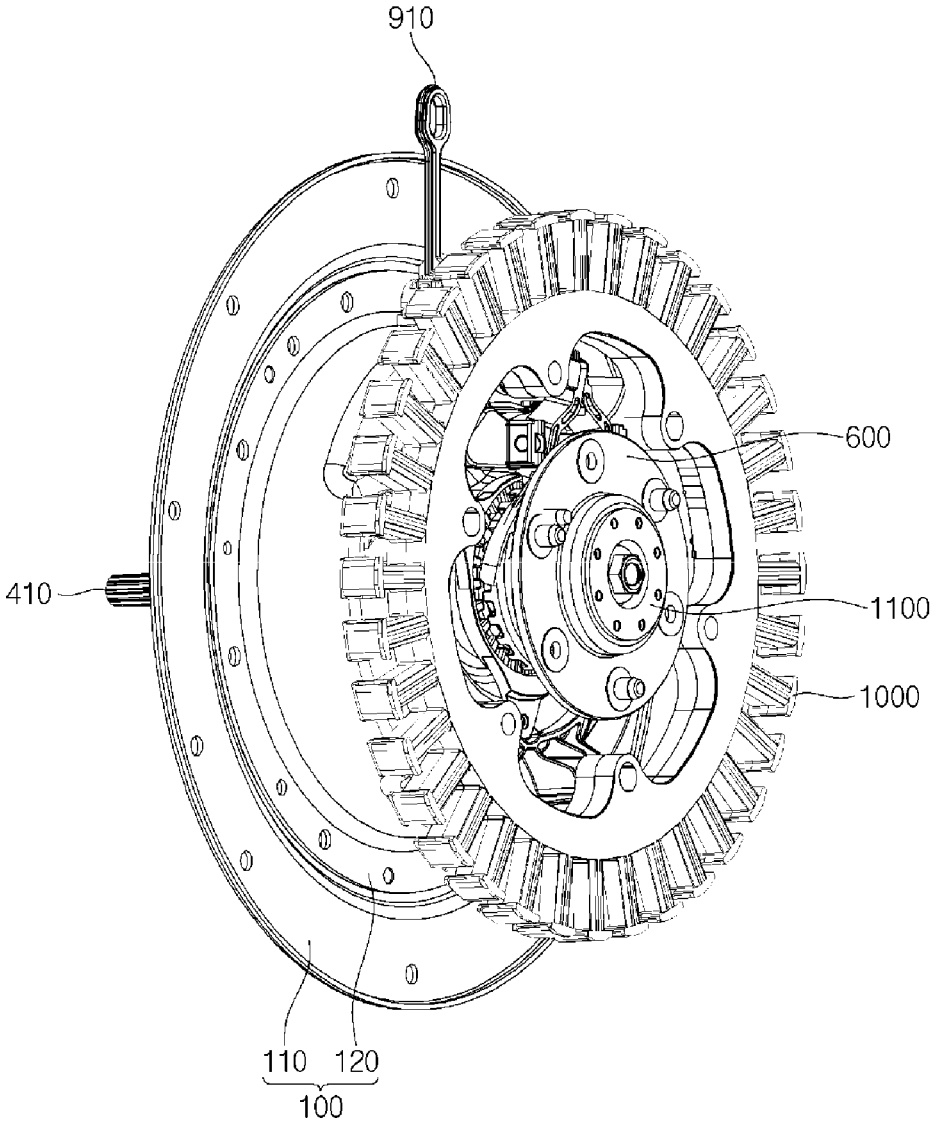
FIG. 6 is a rear side perspective view showing an assembled state of a drive system of a washing machine according to an embodiment of the present disclosure.

FIG. 6 is a rear side perspective view showing an assembled state of a drive system of a washing machine according to an embodiment of the present disclosure.

Figure 7:
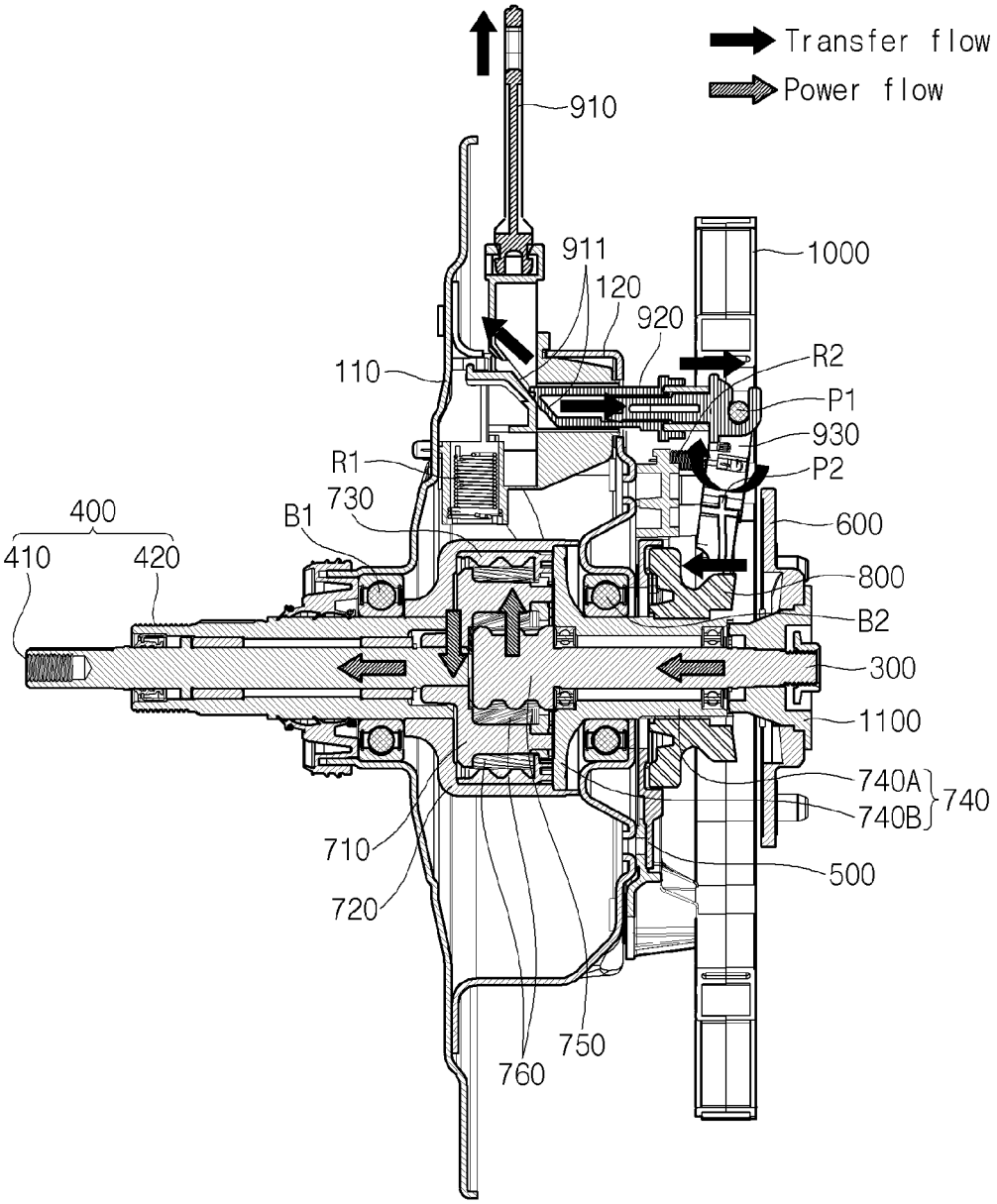
FIG. 7 is a cross-sectional view showing configuration of main parts when a drive system of a washing machine according to an embodiment of the present disclosure operates in a spin-drying initial mode.

FIG. 7 is a cross-sectional view showing configuration of main parts when a drive system of a washing machine according to an embodiment of the present disclosure operates in a spin-drying initial mode.

Figure 8:
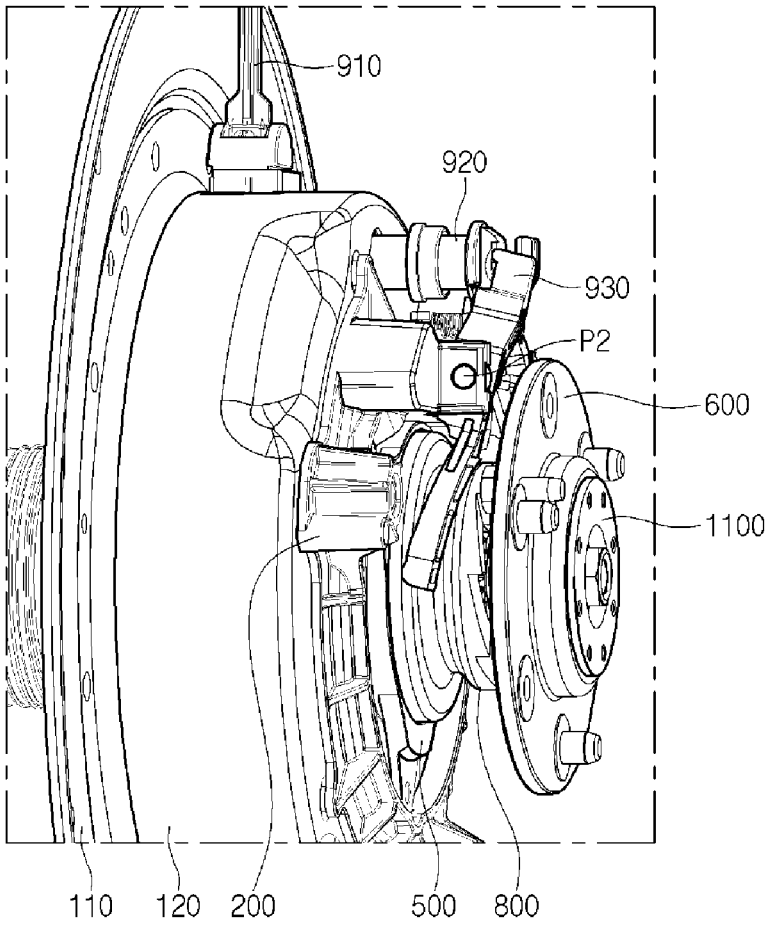
FIG. 8 is a rear side perspective view showing configuration of main parts when a drive system of a washing machine according to an embodiment of the present disclosure operates in a spin-drying initial mode.

FIG. 8 is a rear side perspective view showing configuration of main parts when a drive system of a washing machine according to an embodiment of the present disclosure operates in a spin-drying initial mode.

Figure 9:
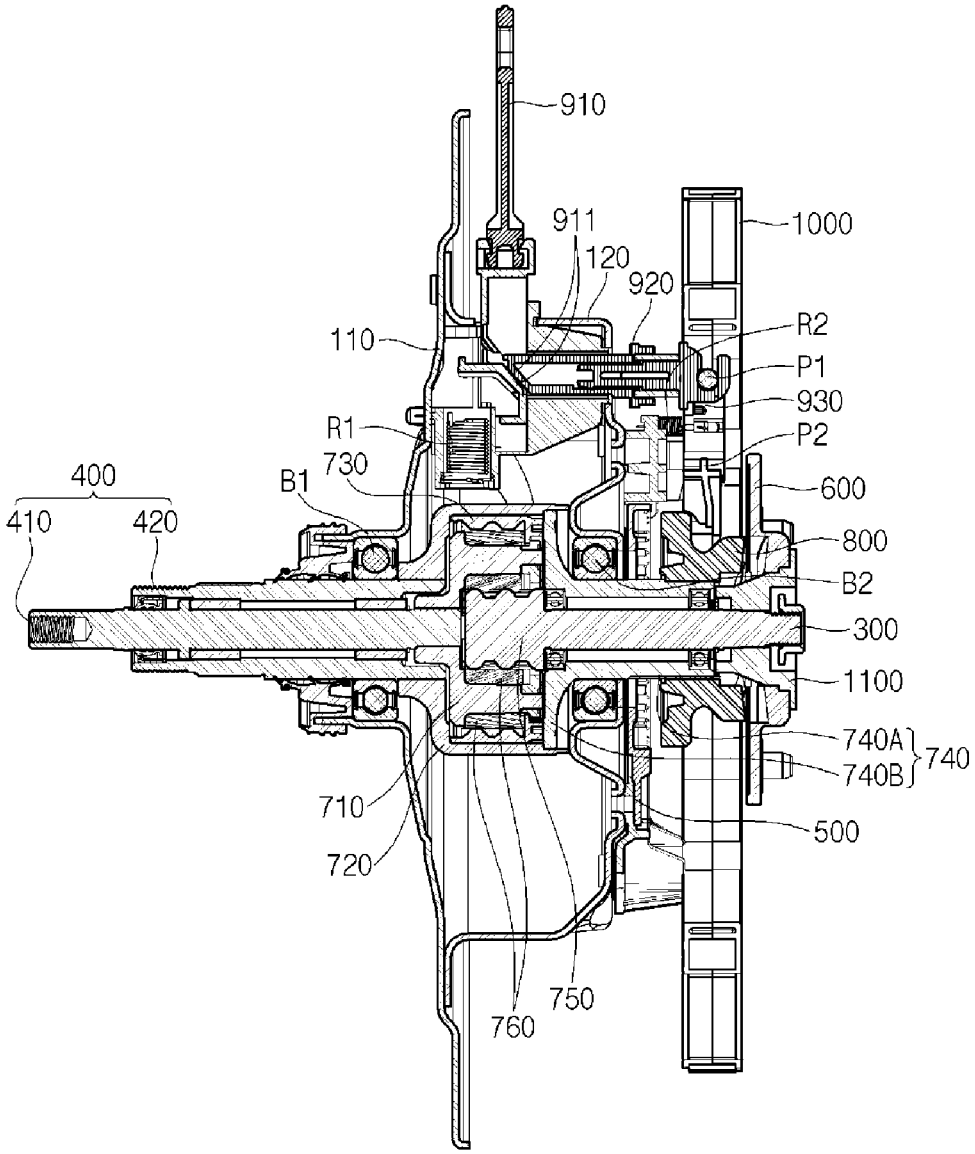
FIG. 9 is a cross-sectional view showing configuration of main parts when a drive system of a washing machine according to an embodiment of the present disclosure operates in a synchronization mode.

FIG. 9 is a cross-sectional view showing configuration of main parts when a drive system of a washing machine according to an embodiment of the present disclosure operates in a synchronization mode.

Figure 10:
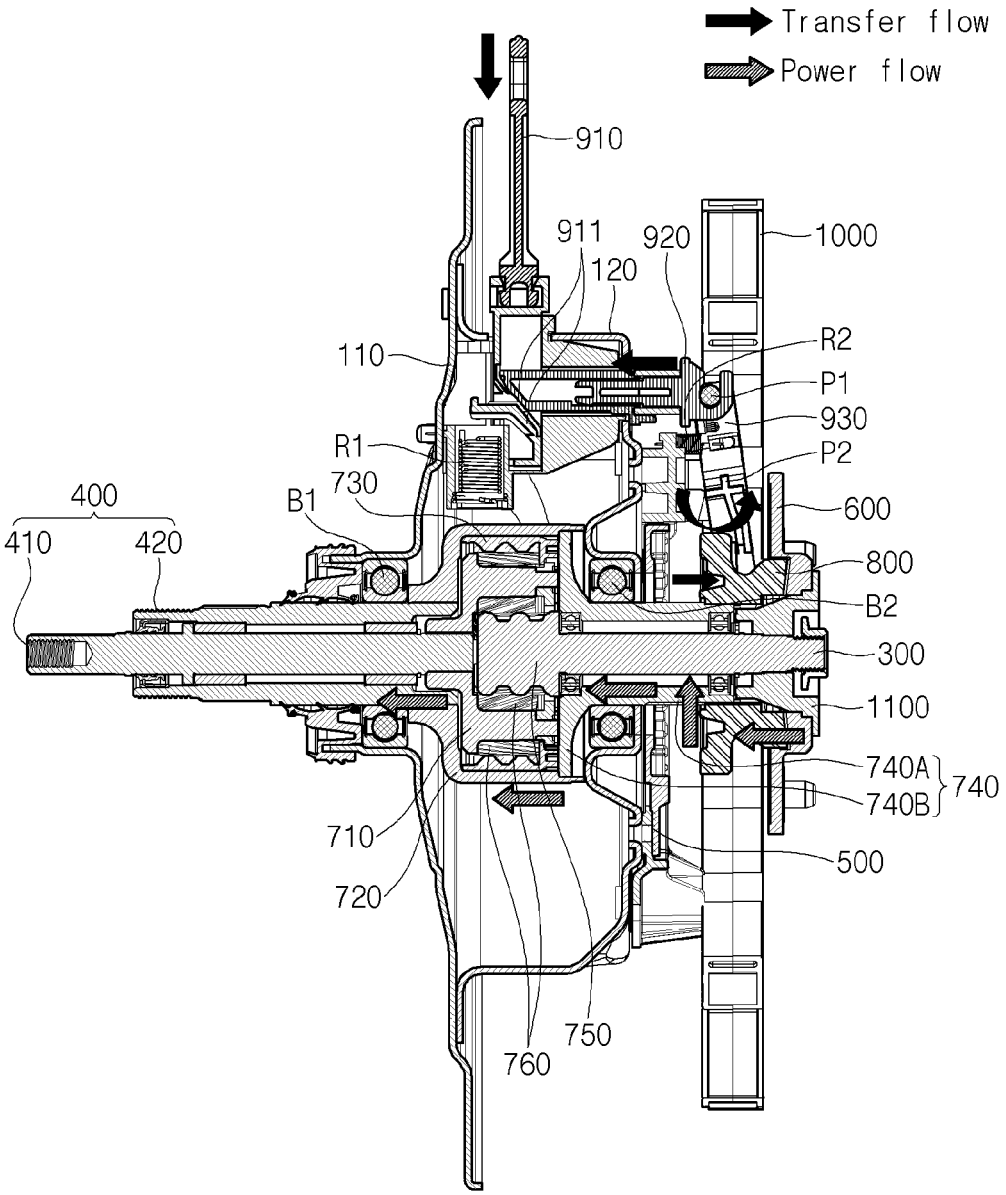
FIG. 10 is a cross-sectional view showing configuration of main parts when a drive system of a washing machine according to an embodiment of the present disclosure operates in a spin-drying mode.

FIG. 10 is a cross-sectional view showing configuration of main parts when a drive system of a washing machine according to an embodiment of the present disclosure operates in a spin-drying mode.

Figure 11:
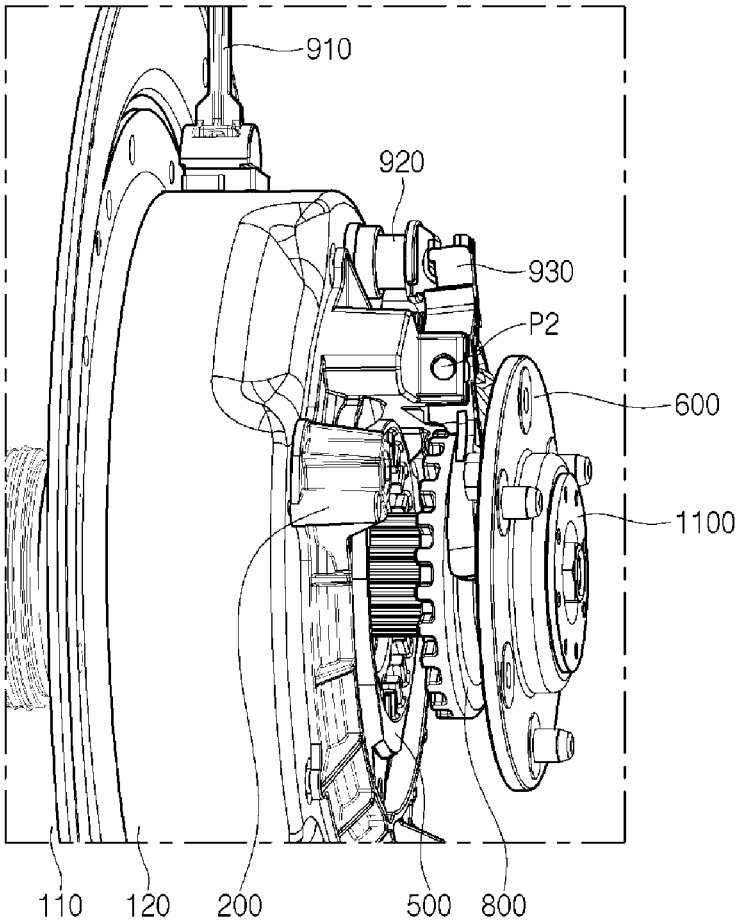
FIG. 11 is a rear side perspective view showing configuration of main parts when a drive system of a washing machine according to an embodiment of the present disclosure operates in a spin-drying mode.

FIG. 11 is a rear side perspective view showing configuration of main parts when a drive system of a washing machine according to an embodiment of the present disclosure operates in a spin-drying mode.

Figure 12:
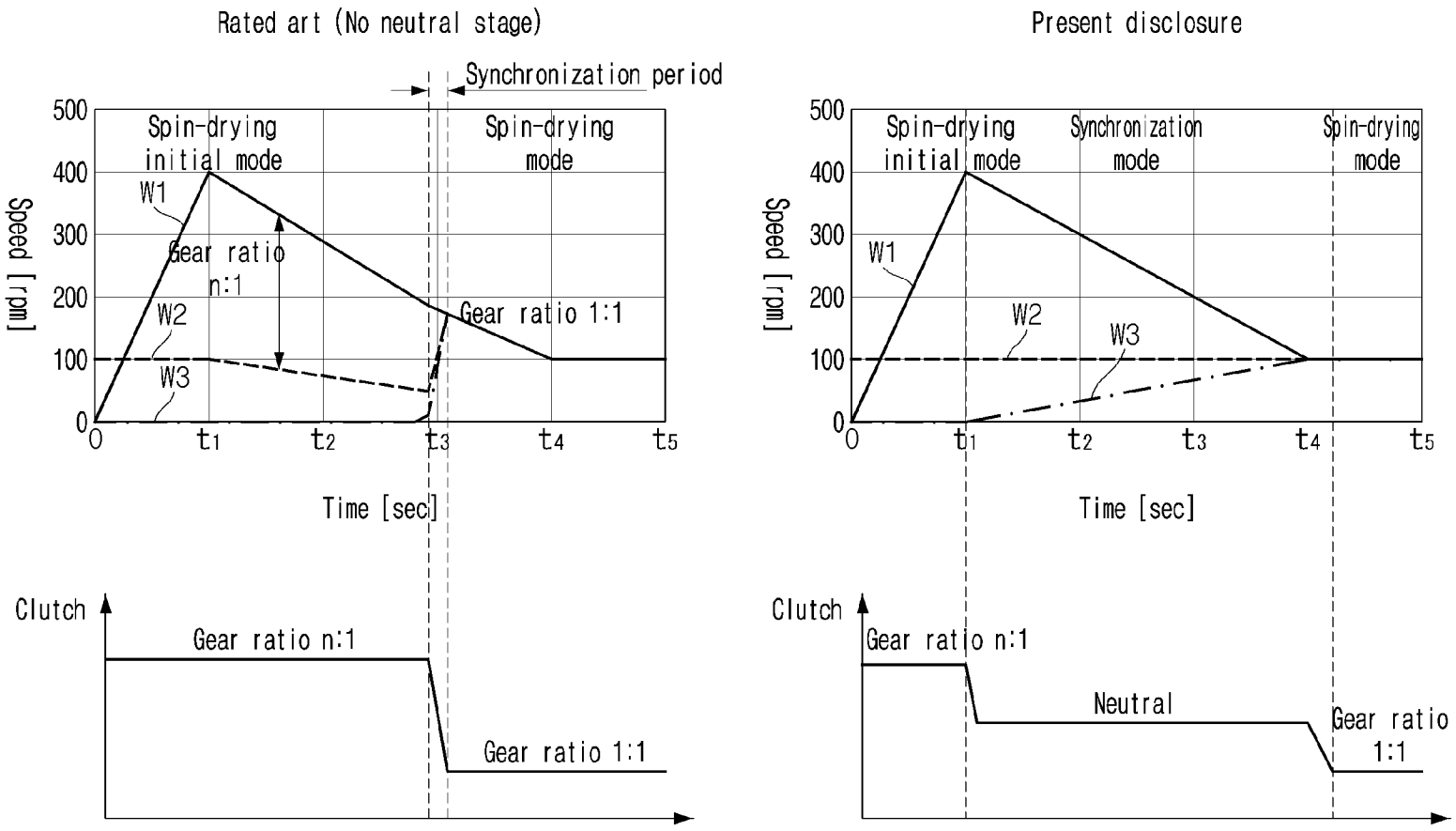
FIG. 12 is a graph comparing shift profiles between a drive system of a washing machine according to the related art and a drive system of a washing machine according to an embodiment of the present disclosure.

FIG. 12 is a graph comparing shift profiles between a drive system of a washing machine according to the related art and a drive system of a washing machine according to an embodiment of the present disclosure.

Figure 13:
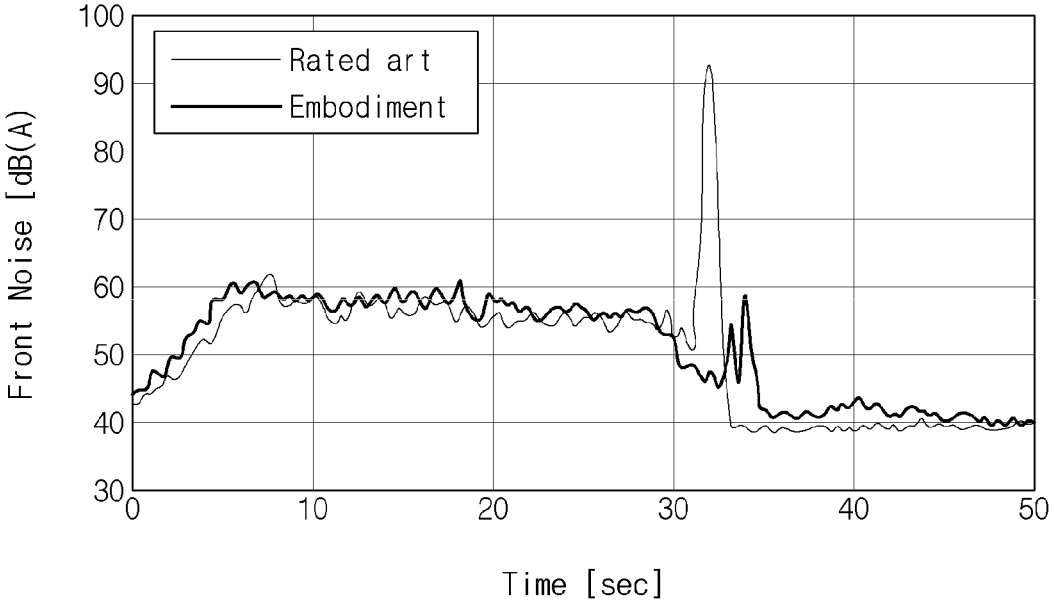
FIG. 13 is a graph comparing shift noises between a drive system of a washing machine according to the related art and a drive system of a washing machine according to an embodiment of the present disclosure.

FIG. 13 is a graph comparing shift noises between a drive system of a washing machine according to the related art and a drive system of a washing machine according to an embodiment of the present disclosure.

A drive system of a washing machine according to an embodiment of the present disclosure, largely, includes a casing 100 having a first case 110 and a second case 120, a rear frame 200 fixed to a rear surface of the second case 120, a rotor shaft 300 whose front end is inserted through the second case 120 and the rear frame 200, an output shaft 400 whose rear end is inserted through the first case 110, an n:1 stage 500 positioned on the rotor shaft 300 outside the casing 100 and coupled to the rear frame 200, a 1:1 stage 600 positioned at a rear of the n:1 stage 500 outside the casing 100 and coupled to the rotor shaft 300 to rotate integrally with the rotor shaft 300, a planetary gear set 700 positioned inside the casing 100 and transmitting a rotational force of the rotor shaft 300 to the output shaft 400 at a ratio of 1:1 or by reducing at a gear ratio of n:1, a dynamic clutch 800 coupled to the n:1 stage 500 or the 1:1 stage 600 or spaced apart from the n:1 stage 500 and the 1:1 stage 600 while moving in the axial direction between the n:1 stage 500 and the 1:1 stage 600, and a clutch driving portion 900 for moving the dynamic clutch 800 in the axial direction.

The rear frame 200 and the second case 120 may be formed as one body. That is, the second case 120 may have a structure including the rear frame. In this case, the n:1 stage 500 may be coupled to the second case 120.

Here, the n:1 stage 500 refers to a plate member coupled to the dynamic clutch so that the rotational force of the rotor shaft is reduced and transmitted to the output shaft at a gear ratio of n:1, and the 1:1 stage 600 refers to a plate member coupled to the dynamic clutch so that rotational force of the rotor shaft is transmitted to the output shaft at a gear ratio of 1:1.

The rear end of the output shaft 400 is inserted through the first case 110, and the front end of the rotor shaft 300 is inserted through the second case 120 and the rear frame 200.

In the following description, "front side" refers to the side where the washing tub (drum or inner tub) is positioned, and "rear side" refers to the side where the motor is positioned.

And "front end" refers to the end of the side where the washing tub (drum or inner tub) is positioned, and "rear end" refers to the end of the side where the motor is positioned.

The first case 110 positioned on the front side may be referred to as a "front case", and the second case 120 positioned on the rear side may be referred to as a "rear case".

The output shaft 400 includes an inner shaft 410 and an outer shaft 420, and spline coupling portions 411 are formed on the outer circumferential surface of the front end and the outer circumferential surface of the rear end of the inner shaft 410, respectively.

The spline coupling portion 411 formed on the outer circumferential surface of the front end of the inner shaft 410 is a part to which the washing tub (drum or inner tub) is coupled, and the spline coupling portion 411 formed on the outer circumferential surface of the rear end of the inner shaft 410 is a part to which the carrier 710 of the planetary gear set 700 to be described later is coupled.

Therefore, the washing tub (drum or inner tub) rotates together with the output shaft 400, and the output shaft 400 rotates together with the carrier 710.

A certain space is formed between the outer shaft 420 and the spline coupling portion 411 formed on the outer circumferential surface of the rear end of the inner shaft 410, and an end of the carrier 710 may be inserted into a space between the inner shaft 410 and the outer shaft 420 and coupled to the spline coupling portion 411 formed on the outer circumferential surface of the rear end of the inner shaft 410.

According to this configuration, the rotational force of the carrier 710 may be accurately transmitted to the output shaft 400.

A first bearing B1 may be installed between the outer shaft 420 and the first case 110.

The planetary gear set 700 is installed on the output shaft 400 to the rear of the first bearing B1.

The planetary gear set 700 is positioned inside the casing 100 formed by the first case 110 and the second case 120.

The planetary gear set 700 is provided to transmit the rotational force of the rotor shaft 300 to the output shaft 400 at a gear ratio of 1:1 or by reducing at a gear ratio of n:1.

The planetary gear set 700 includes a carrier 710 spline-coupled to the inner shaft 410 of the output shaft 400, a gear cover 720 surrounding the carrier 710, a ring gear 730 positioned between the gear cover 720 and the carrier 710, a ring gear shaft 740 coupled to the ring gear 730 and the gear cover 720, a sun gear 750 positioned inside the carrier 710 and positioned at the front end of the rotor shaft 300, and a plurality of pinion gears 760 supported by the carrier 710 and positioned between the sun gear 750 and the ring gear 730.

The sun gear 750, the ring gear 730, and the plurality of pinion gears 760 do not move in the axial direction, respectively.

Accordingly, the sun gear 750, the ring gear 730, and the plurality of pinion gears 760 may have a helical gear, respectively.

According to this configuration, it is possible to increase the safety factor of the gears provided in the planetary gear set 700, and reduce operating noise generated during gear rotation.

The ring gear shaft 740 includes a shaft portion 740A surrounding a part of the circumference of the rotor shaft 300 and a plate portion 740B positioned at the front end of the shaft portion 740A.

The gear cover 720 is coupled to the plate portion 740B of the ring gear shaft 740, and the sun gear 750, the plurality of pinion gears 760, and the ring gear 730 are positioned in the inner space formed by the plate portion 740B and the gear cover 720.

The ring gear 730 is coupled to the plate portion 740B of the ring gear shaft 740. Accordingly, the ring gear shaft 740 and the ring gear 730 rotate integrally.

The carrier 710 supporting the plurality of pinion gears 760 is spline-coupled with the inner shaft 410 of the output shaft 400.

Accordingly, the plurality of pinion gears 760 supported by the carrier 710 may rotate and/or revolve according to the rotation of the sun gear 750 and the ring gear 730.

A second bearing B2 is positioned between the shaft portion 740A of the ring gear shaft 740 and the second case 120.

Therefore, the rotating shafts (rotor shaft and output shaft) are effectively supported by the first bearing B1 and the second bearing B2 in the spin-drying initial mode/synchronization mode/spin-drying mode.

Another bearing may be positioned between the shaft portion 740A of the ring gear shaft 740 and the rotor shaft 300.

Therefore, even when the ring gear shaft 740 is stopped, the rotor shaft 300 can freely rotate.

The dynamic clutch 800 is coupled to the shaft portion 740A of the ring gear shaft 740. The shaft portion 740A of the ring gear 730 and the dynamic clutch 800 may be spline-coupled by a spline coupling portion 810.

Therefore, the dynamic clutch 800 can move in the axial direction of the ring gear shaft 740 in a state of being coupled to the shaft portion 740A of the ring gear shaft 740, and also, rotate integrally with the ring gear shaft 740.

According to this configuration, by controlling rotation of the ring gear shaft 740 to which the dynamic clutch 800 is coupled, it is possible to selectively perform the spin-drying initial mode/synchronization mode/spin-drying mode.

In addition, the rotational force of the dynamic clutch 800 can be effectively transmitted to the ring gear shaft 740 (in the spin-drying mode), and the rotational force of the ring gear shaft 740 can be effectively transmitted to the dynamic clutch 800 (in the synchronization mode).

The rear frame 200 is coupled to the rear surface of the second case 120.

A stator 1000 is integrally coupled to the rear frame 200, and although not shown, the rotor disposed around the stator 1000 is integrally coupled to the rotor shaft 300 by a coupling shaft 1100.

The rotor shaft 300 is inserted through the rear frame 200 and the second case 120, and the n:1 stage 500 is coupled to the rear frame 200 on the rotor shaft 300.

The n:1 stage 500 is positioned on the front side of the dynamic clutch 800 with respect to the dynamic clutch 800.

In addition, based on the dynamic clutch 800, the 1:1 stage 600 is positioned on the rear side opposite to the front side where the n:1 stage 500 is positioned, and the 1:1 stage 600 is integrally coupled to the rotor shaft 300 by the coupling shaft 1100.

Therefore, when the rotor rotates, the rotor shaft 300 and the 1:1 stage 600 integrally coupled with the rotor shaft 300 rotate integrally with the rotor.

According to this configuration, since the dynamic clutch 800 is positioned in front of the rotor and the stator 1000, the volume of the washing machine, particularly the volume of the washing tub (drum or inner tub), can be advantageously secured.

The dynamic clutch 800 may include a first clutch portion 820 facing the n:1 stage 500, a second clutch portion 830 facing the 1:1 stage 600, and a connection portion 840 connecting the first clutch portion 820 and the second clutch portion 830 to each other, and the connection portion 840 may have a smaller diameter than the first clutch portion 820 and the second clutch portion 830.

A plurality of first gears 821 formed in a quadrangular or trapezoidal shape and coupled to each other may be provided on a surface where the first clutch portion 820 and the n:1 stage 500 face each other, respectively, and a plurality of second gears 831 formed in a shape having an inclined plane 831*a* and a vertical surface 831*b* and coupled to each other may be provided on a surface where the second clutch portion 830 and the 1:1 stage 600 face each other, respectively.

Forming the shape of the first gear 821 as described above is because the coupling between the first gears 821 is made in a stationary state, and forming the shape of the second gear 831 as described above is because the coupling between the second gears 831 is made in a dynamic state.

When the second gear 831 is formed in the shape described above, when the coupling between the second gears 831 is made in a dynamic state, wear or damage and noise of the gear caused by collision between the second gears 831 may be reduced.

The height of the second gear 831, that is, the height of the vertical surface 831*b* may be formed to be approximately 10 mm, the angle of the inclined plane 831*a* may be formed to be approximately 10 degrees, the number of the second gears 831 provided in the dynamic clutch 800 and the number of the second gears 831 provided in the 1:1 stage 600 may each be formed as eight.

However, the shape of the second gear 831 may be variously modified.

The second gear 831 of the second clutch portion 830 and the second gear 831 of the 1:1 stage 600 may be coupled to each other in a state in which the rotational speed of the dynamic clutch 800 and the rotational speed of the 1:1 stage 600 are synchronized.

According to this configuration, the wear safety factor of the dynamic clutch 800 may be increased.

The first gear 821 respectively provided in the n:1 stage 500 and the dynamic clutch 800 may be formed in the same or similar shape as the second gear 831.

The clutch driving portion 900 for driving the dynamic clutch 800 may include a fork lever 910, a connecting rod 920, and a fork 930.

The fork lever 910 is installed through the second case 120 in a vertical direction and is moved in the vertical direction by an actuator.

Although not shown, the fork lever 910 is connected to the actuator.

The actuator may be formed in various structures, and the structure of the actuator is not particularly limited in the present disclosure.

Therefore, when the actuator is operated, the fork lever 910 moves in the vertical direction.

The connecting rod 920 is coupled to the fork lever 910 and moves in a horizontal direction as the fork lever 910 moves in the vertical direction.

An internal space for horizontal movement of the connecting rod 920 is provided inside the fork lever 910, and the fork lever 910 and the connecting rod 920 may each include an inclined portion 911 for allowing the connecting rod 920 to move in a horizontal direction as the fork lever 910 moves in the vertical direction.

The fork lever 910 may be returned to its original position by a first return spring R1.

According to this configuration, the fork lever 910 can be operated smoothly.

In addition, by adjusting the position of the fork lever 910 connected to the actuator, it is possible to position the dynamic clutch 800 at an exact position according to the spin-drying initial mode/synchronization mode/spin-drying mode.

One end of the fork 930 is coupled to the connecting rod 920, and the other end of the fork 930 is coupled to the dynamic clutch 800.

The fork 930 rotates according to the principle of the leverage. To this end, a first pin P1 coupled to the connecting rod 920 is provided at an upper end of the fork 930, and a second pin P2 coupled to the rear frame 200 is provided at a middle portion of the fork 930.

And a lower end of the fork 930 is coupled to the connection portion 840 of the dynamic clutch 800.

Accordingly, when the connecting rod 920 moves in the horizontal direction, the fork 930 rotates based on the second pin P2 coupled to the rear frame 200 to adjust the position of the dynamic clutch.

According to this configuration, since the fork rotates according to the principle of leverage, it is possible to sufficiently secure the axial force necessary for the movement of the dynamic clutch 800 even with a small-sized actuator.

In addition, since the position of the dynamic clutch is mechanically controlled and maintained using the fork 930, the synchronization mode, in which speed synchronization between the dynamic clutch 800 and the rotor shaft 300 is performed, can be formed at an exact position between the spin-drying initial mode and the spin-drying mode.

In addition, since the actuator for driving the fork lever 910 is positioned on the front side of the rotor and the stator 1000, it is possible to easily perform wiring work of the actuator for moving the dynamic clutch 800 in the axial direction.

The connecting rod 920 may be returned to its original position by a second return spring R2.

According to this configuration, the connecting rod 920 can be operated smoothly.

According to the drive system of the washing machine described above, since a synchronization mode is performed at an exact position between the spin-drying initial mode in which the output shaft rotates at low speed and high torque and the spin-drying mode in which the output shaft rotates at high speed and low torque to provide a dynamic clutch that can effectively synchronize the rotational speeds of the output shaft and rotor shaft, it is possible to change from the spin-drying initial mode to the spin-drying mode through the synchronization mode even while the motor is rotating.

In addition, since a high torque is not required at the start of the spin-drying mode, down sizing of the motor and motor driving circuit is possible.

Hereinafter, the spin-drying initial mode, the synchronization mode, and the spin-drying mode will be described with reference to FIGS. 7 to 13.

FIGS. 7 and 8 are diagrams related to the spin-drying initial mode, FIG. 9 is a diagram related to the synchronization mode, and FIGS. 10 and 11 are diagrams related to the spin-drying mode.

In FIGS. 7 and 10, arrows indicated as "transfer flow" indicate a path through which the fork lever is operated by the operation of the actuator, and the operating force of the fork lever is transmitted to the dynamic clutch, and arrows indicated as "power flow" indicate a path through which the rotational force of the rotor shaft is transmitted to the output shaft.

FIG. 12 is a graph comparing shift profiles between a drive system of a washing machine according to the related art and a drive system of a washing machine according to an embodiment of the present disclosure, and FIG. 13 is a graph comparing shift noises between a drive system of a washing machine according to the related art and a drive system of a washing machine according to an embodiment of the present disclosure.

In FIGS. 12 and 13, the drive system of the washing machine according to the related art refers to a drive system of a washing machine that does not have a neutral stage and does not separately have a synchronization mode.

First, the spin-drying initial mode will be described.

Typically, after both the washing mode and the rinsing mode are completed, a draining mode for discharging water filled in the washing tub (drum or inner tub) is performed.

Since the draining mode is performed in a state in which the motor is stationary, the rotor shaft 300 maintains a stationary state, and accordingly, the output shaft 400 also maintains a stationary state.

Since the output shaft must be driven at high speed and low torque in the washing mode, the dynamic clutch 800 is coupled to the n:1 stage 500.

That is, when the fork lever 910 is pulled upward by operating the actuator to proceed with the washing mode, the connecting rod 920 moves backward due to an interaction between the inclined portion 911 of the fork lever 910 and the inclined portion 911 of the connecting rod 920.

When the connecting rod 920 moves backward, the fork 930 rotates clockwise around the second pin P2, and the dynamic clutch 800 coupled to the fork 930 moves forward on the shaft portion 740A of the ring gear shaft 740.

Therefore, the first gear 821 of the dynamic clutch 800 is coupled to the first gear 821 of the n:1 stage 500.

In the draining mode, the dynamic clutch 800 may be maintained in a state coupled to the n:1 stage 500 as in the washing mode.

Therefore, even in the spin-drying initial mode performed after the draining mode, the dynamic clutch 800 may be maintained in a state coupled to the n:1 stage 500.

However, since the driving of the motor is stopped to proceed with the draining mode, when the spin-drying initial mode starts, the motor is driven, and the rotational speed W1 of the rotor shaft 300 increases until it reaches a first rotation speed (e.g. 400 rpm).

When the rotor shaft 300 is rotated, the rotational force of the rotor shaft 300 is sequentially transmitted to the output shaft 400 through the sun gear 750 coupled to the rotor shaft 300, the plurality of pinion gears 760 coupled to the sun gear 750, and the carrier 710 supporting the plurality of pinion gears 760.

Accordingly, the rotational force of the rotor shaft 300 is reduced at a gear ratio of n:1 by the planetary gear set 700, and accordingly, the rotational speed W2 of the output shaft 400 is maintained at a second rotational speed (e.g. 100 rpm) lower than the first rotational speed.

Also, the rotational speed W3 of the dynamic clutch 800 is maintained at zero.

In the spin-drying initial mode, since the n:1 stage 500, the ring gear shaft 740, and the ring gear 730 rotate integrally with the dynamic clutch 800, the rotational speeds of the n:1 stage 500, the ring gear shaft 740, and the ring gear 730 are also maintained at zero.

When the synchronization mode is executed after the spin-drying initial mode ends, the actuator operates and the fork lever 910 moves downward.

Accordingly, the connecting rod 920 moves forward due to an interaction between the inclined portion 911 of the fork lever 910 and the inclined portion 911 of the connecting rod 920.

The synchronization mode may be implemented by maintaining the position of the fork lever in a neutral position for a certain period of time (e.g. 3 seconds or longer).

Here, the neutral position means a region where the dynamic clutch 800 is separated from the n:1 stage 500 and the 1:1 stage 600, respectively, and positioned at a neutral stage between the n:1 stage 500 and the 1:1 stage 600.

And the neutral position of the fork lever 910 can be accurately and reliably maintained for a preset time by the actuator.

When the connecting rod 920 moves forward, the fork 930 rotates counterclockwise around the second pin P2, and the dynamic clutch 800 coupled to the fork 930 moves backward on the shaft portion 740A of the ring gear shaft 740.

Accordingly, the coupling between the first gear 821 of the dynamic clutch 800 and the first gear 821 of the n:1 stage 500 is released, and is positioned in the neutral stage, and the position of the dynamic clutch 800 is maintained in the neutral stage for a predetermined time (e.g. 3 seconds or more).

The margin of the synchronization mode, that is, the size or width of the neutral stage may be appropriately set as an interval between the n:1 stage 500 and the 1:1 stage 600.

That is, the size or width of the neutral stage may be appropriately set as a moving distance of the dynamic clutch moving in the axial direction between the n:1 stage 500 and the 1:1 stage 600.

In the synchronization mode, the rotational speed W1 of the rotor shaft 300 is reduced to the second speed (e.g. 100 rpm) lower than the first rotational speed, and the rotational speed W2 of the output shaft 400 is maintained at the second speed, and the rotational speed W3 of the dynamic clutch 800 increases up to the second speed.

In the synchronization mode, the reason why the rotational speed W2 of the dynamic clutch 800 increases to the second speed is that the plurality of pinion gears 760 rotate and revolve, respectively.

Thus, the rotational speed W2 of the dynamic clutch 800 is synchronized with the rotational speed W1 of the rotor shaft 300.

Although FIG. 12 shows that the synchronization mode proceeds immediately after the rotational speed W1 of the rotor shaft 300 reaches the first rotational speed in the spin-drying initial mode, in the spin-drying initial mode, the rotational speed W1 of the rotor shaft 300 may be maintained for a predetermined time after reaching the first rotational speed, and then the synchronization mode may be executed.

As the synchronization mode progresses, after the rotational speed W2 of the dynamic clutch 800 is synchronized with the rotational speed W1 of the rotor shaft 300, the spin-drying mode is executed.

Although FIG. 12 shows that the spin-drying mode is executed after a certain time elapses after the rotational speed W2 of the dynamic clutch 800 is synchronized with the rotational speed W1 of the rotor shaft 300, the spin-drying mode may be executed from the time when the rotational speed W2 of the dynamic clutch 800 is synchronized with the rotational speed W1 of the rotor shaft 300.

When the spin-drying mode is executed, the actuator operates to further move the fork lever 910 downward.

Therefore, the connecting rod 920 further moves forward due to an interaction between the inclined portion 911 of the fork lever 910 and the inclined portion 911 of the connecting rod 920.

Further, when the connecting rod 920 moves further forward, the fork 930 further rotates counterclockwise around the second pin P2, and the dynamic clutch 800 coupled to the fork 930 further moves backward on the shaft portion 740A of the ring gear shaft 740.

Thus, the second gear 831 of the dynamic clutch 800 and the second gear 831 of the 1:1 stage 600 are coupled.

Therefore, the 1:1 stage 600 and the dynamic clutch 800 coupled to the 1:1 stage 600 rotate integrally with the rotor shaft 300, and the rotational force of the rotor shaft 300 is transmitted to the output shaft 400 through the planetary gear set 700 that rotates entirely around the rotor shaft 300.

While the spin-drying mode is executed, the rotational speed W1 of the rotor shaft 300, the rotational speed W2 of the output shaft 400, and the rotational speed W3 of the dynamic clutch 800 are maintained at the same second rotational speed (e.g. 100 rpm).

It can be seen that a shift profile of the drive system of the washing machine of this configuration is completely different from a shift profile of the drive system of the washing machine according to the related art.

That is, referring to FIG. 12, in the drive system of the washing machine according to the related art, which does not have a neutral stage and does not have a separate synchronization mode, the rotational speed W1 of the rotor shaft and the rotational speed W2 of the output shaft are gradually decreased before the spin-drying initial mode ends, and then the rotational speed W3 of the clutch rapidly increases and is synchronized with the rotational speed W2 of the output shaft in the synchronization period formed immediately before entering the spin-drying mode, thereafter, the rotational speed W2 of the output shaft and the rotational speed W3 of the clutch rapidly increase and are synchronized with the rotational speed W1 of the rotor shaft, and then the spin-drying mode proceeds.

Therefore, the drive system of the washing machine according to the related art and the drive system of the washing machine according to the present disclosure have a difference in the rotational speed of the output shaft in the spin-drying initial mode.

That is, in the drive system of the washing machine according to the related art, the rotational speed of the output shaft gradually decreases in the spin-drying initial mode, but in the drive system according to the present disclosure, the rotational speed of the output shaft is maintained constant during the spin-drying initial mode.

In addition, the drive system of the washing machine according to the related art, and the drive system of the washing machine according to the present disclosure have a difference in rotational speed of the rotor shaft in the spin-drying initial mode.

That is, in the drive system of the washing machine according to the related art, the rotational speed of the rotor shaft increases to the first rotational speed and then decreases in the spin-drying initial mode, but in the drive system of the washing machine according to the present disclosure, the rotational speed of the rotor shaft increases to the first rotational speed, or is maintained at the first rotational speed for a predetermined time after increasing to the first rotational speed.

Therefore, in the drive system of the washing machine according to the related art, since the synchronization period is formed very short, approximately 0.2 seconds, as shown in FIG. 13, in the process (synchronization period) of changing from the spin-drying initial mode to the spin-drying mode, shift shock and shift noise (noise measured from the front of the washing machine) are greatly generated.

However, according to the drive system of the washing machine according to the present disclosure, since it is possible to stably and accurately secure the synchronization mode for a sufficient time (e.g. approximately 3 seconds or more), shift shock and shift noise are greatly reduced compared to the drive system of the washing machine according to the related art.

The drive system of the washing machine according to the present disclosure described above may be installed in a front-loading type washing machine, for example, a "drum washing machine" in which a washing tub (drum or inner tub) is disposed in a horizontal direction, and transmit driving force of the motor to the washing tub (drum or inner tub).

When the drive system of the washing machine according to the present disclosure is applied to the drum washing machine, the rotor shaft and the output shaft may be spaced apart from each other in the horizontal direction.

In the top-loading type washing machine in which the washing tub (drum or inner tub) is placed in an upright position, for example, a "pulsator washing machine", since the laundry is flatly disposed on the bottom surface of the washing tub (drum or inner tub), the starting torque during the spin-drying is smaller than that of the front-loading type washing machine.

However, in the front-loading type washing machine in which the washing tub (drum or inner tub) is disposed in the horizontal direction, for example, a "drum washing machine", since laundry is disposed on the bottom of the wall of the washing tub (drum or inner tub), not on the bottom of the washing tub (drum or inner tub), the starting torque during the spin-drying is higher than that of the top-loading type washing machines.

Therefore, the intelligent power module (IPM) of the inverter provided in the front-loading type pulsator washing machine must use a product with a larger capacity than the intelligent power module of the inverter provided in the top-loading type drum washing machine.

For example, it is possible to use an intelligent power module with a capacity of 5 A in the top-loading type pulsator washing machine, but an intelligent power module with a capacity of 15 A must be used in the front-loading type drum washing machine.

Generally, the current value (Apk) at the peak of an intelligent power module having a capacity of 5 A is 3 Apk, and the current value at the peak of an intelligent power module having a capacity of 15 A is 9 to 11 Apk.

In addition, in a conventional front-loading type drum washing machine without a clutch, a motor having a large capacity was required to rotate the drum at different rotational speeds during washing and spin-drying.

However, when the drive system of the washing machine according to the present disclosure is applied to the front-loading type drum washing machine, it is possible to reduce the starting torque during washing and spin-drying compared to a conventional front-loading type drum washing machine not equipped with the drive system of the washing machine according to the present disclosure.

Therefore, it is possible for the front-loading type drum washing machine equipped with the drive system of the washing machine according to the present disclosure to use an intelligent power module with a smaller capacity than the conventional front-loading type drum washing machine.

For example, in the front-loading type drum washing machine equipped with the drive system of the washing machine according to the present disclosure, it is possible to use an intelligent power module with a capacity of 5 A.

Therefore, since it is possible to use an inexpensive intelligent power module having a small capacity, the manufacturing cost of the washing machine can be reduced.

Further, since there is no need to use a motor with a large capacity, downsizing of the motor is possible.

It is apparent to those skilled in the art that the present disclosure may be embodied in other specific forms without departing from the essential characteristics of the present disclosure. Accordingly, the above detailed description should not be construed as restrictive in all respects but should be considered as illustrative. The scope of the present disclosure should be determined by reasonable interpretation of the appended claims, and all changes within the equivalent scope of the present disclosure are included in the scope of the present disclosure.

What is claimed is:

1. A drive system of a washing machine comprising:

a rotor shaft;

an output shaft positioned apart from the rotor shaft;

a planetary gear set including a ring gear shaft, the ring gear shaft surrounding a part of a circumference of the rotor shaft and configured to transmit a rotational force of the rotor shaft to the output shaft at a gear ratio of 1:1 or at a reduced gear ratio;

a dynamic clutch coupled to the ring gear shaft, the dynamic clutch being configured to move in an axial direction of the ring gear shaft and rotate together with the ring gear shaft;

a clutch driving portion configured to move the dynamic clutch in the axial direction;

a first stage positioned at the rotor shaft in front of the dynamic clutch and coupled to the dynamic clutch; and a second stage positioned behind the dynamic clutch, the second stage being coupled to the rotor shaft and configured to rotate together with the rotor shaft, and the second stage being further coupled to the dynamic clutch, wherein the washing machine is configured to operate in a spin-drying initial mode, a spin-drying mode, and a synchronization mode, the synchronization mode being performed between the spin-drying initial mode and the spin-drying mode, wherein the first stage is configured to, in the spin-drying initial mode, transmit the rotational force of the rotor shaft to the output shaft at the reduced gear ratio, wherein the second stage is configured to, in the spin-drying mode, transmit the rotational force of the rotor shaft to the output shaft at a gear ratio of 1:1, wherein the dynamic clutch is configured to, in the synchronization mode, be separated from the first stage and the second stage, respectively, and be positioned at a neutral stage to thereby synchronize a rotational speed of the rotor shaft with a rotational speed of the output shaft by the planetary gear set, wherein the ring gear shaft includes:

a shaft portion surrounding the part of the circumference of the rotor shaft, and a plate portion positioned at a front end of the shaft portion, and wherein spline coupling portions are coupled to each other and are provided at an outer circumferential surface of the shaft portion and an inner circumferential surface of the dynamic clutch, respectively, and wherein the planetary gear set includes:

a sun gear positioned at a part of an outer circumferential surface of the rotor shaft in front of the plate portion of the ring gear shaft, a gear cover coupled to the plate portion of the ring gear shaft and accommodating the sun gear therein, a ring gear disposed in an inner space that is defined by the gear cover and the plate portion of the ring gear shaft, the ring gear being coupled to the plate portion of the ring gear shaft and configured to rotate together with the ring gear shaft, a plurality of pinion gears disposed between the ring gear and the sun gear in the inner space defined by the gear cover and the plate portion of the ring gear shaft, and a carrier disposed at the inner space defined by the gear cover and the plate portion of the ring gear shaft and configured to support the plurality of pinion gears, the carrier being configured to rotate together with the output shaft based on one end of the carrier being coupled to the output shaft.

2. The drive system of claim 1, wherein the rotational speed of the rotor shaft is configured to, in the spin-drying initial mode, increase until reaching a first rotational speed, wherein the output shaft is configured to, in the spin-drying initial mode, maintain a second rotational speed lower than the first rotational speed, and wherein the dynamic clutch is configured to, in the spin-drying initial mode, remain in a stationary state.

3. The drive system of claim 2, wherein the rotational speed of the rotor shaft is configured to, in the synchronization mode, be reduced from the first rotational speed to the second rotational speed, wherein the output shaft is configured to, in the synchronization mode, maintain the second rotational speed, and wherein a rotational speed of the dynamic clutch is configured to, in the synchronization mode, increase until reaching the second rotational speed.

4. The drive system of claim 3, wherein the rotational speed of the rotor shaft, the rotational speed of the output shaft, and the rotational speed of the dynamic clutch are configured to, in the spin-drying mode, be maintained at the second rotational speed, respectively.

5. The drive system of claim 1, wherein the sun gear, the ring gear, and the plurality of pinion gears each include a helical gear.

6. The drive system of claim 1, wherein the output shaft includes:

an inner shaft that couples the carrier; and an outer shaft that is positioned outside the inner shaft and coupled to the gear cover, wherein the spline coupling portions are coupled to each other and are defined at an outer circumferential surface of the inner shaft and an inner circumferential surface of the carrier, respectively, and wherein a part of the carrier is inserted into a space between the inner shaft and the outer shaft.

7. The drive system of claim 6, further comprising:

a casing that accommodates the planetary gear set therein and includes a first case and a second case, wherein a rear end of the output shaft is inserted through the first case, and a front end of the rotor shaft is inserted through the second case, a first bearing that supports the output shaft and is positioned between the outer shaft and the first case, and a second bearing that supports the rotor shaft and is positioned between the shaft portion of the ring gear shaft and the second case.

8. The drive system of claim 1, wherein the first stage, the dynamic clutch coupled to the first stage, the ring gear shaft coupled to the dynamic clutch, and the ring gear coupled to the plate portion of the ring gear shaft are configured to, in the spin-drying initial mode, be maintained in a stationary state, and wherein, in the spin-drying initial mode, the rotational force of the rotor shaft is sequentially transmitted to the output shaft through the sun gear coupled to the rotor shaft, the plurality of pinion gears coupled to the sun gear, and the carrier supporting the plurality of pinion gears.

9. The drive system of claim 1, wherein the first stage, the second stage, the dynamic clutch, the ring gear shaft coupled to the dynamic clutch, and the ring gear coupled to the plate portion of the ring gear shaft are configured to, in the synchronization mode, be maintained in a stationary state, wherein, in the synchronization mode, the rotational force of the rotor shaft is sequentially transmitted to the output shaft through the sun gear coupled to the rotor shaft, the plurality of pinion gears coupled to the sun gear, and the carrier supporting the plurality of pinion gears, and wherein, in the synchronization mode, the rotational speed of the dynamic clutch is increased based on the plurality of pinion gears each rotating and revolving, and synchronized with the rotational speed of the rotor shaft.

10. The drive system of claim 1, wherein the second stage and the dynamic clutch coupled to the second stage are configured to, in the spin-drying mode, rotate together with the rotor shaft, and wherein, in the spin-drying mode, the rotational force of the rotor shaft is transmitted to the output shaft through the planetary gear set rotating entirely around the rotor shaft.

11. The drive system of claim 1, wherein the dynamic clutch includes (i) a first clutch portion facing the first stage and (ii) a second clutch portion facing the second stage, wherein a plurality of first gears have a quadrangular or trapezoidal shape and are coupled to each other, the plurality of first gears being provided at a surface where the first clutch portion and the first stage face each other, respectively, and wherein a plurality of second gears have a shape having an inclined surface and a vertical surface and are coupled to each other, the plurality of second gears being provided at a surface where the second clutch portion and the second stage face each other, respectively.

12. The drive system of claim 11, wherein the plurality of second gears are coupled to each other based on the rotational speed of the dynamic clutch being synchronized with the rotational speed of the second stage.

13. The drive system of claim 11, further comprising:

a casing that accommodates the planetary gear set therein and includes a first case and a second case; and a rear frame that is fixed to a rear surface of the second case, wherein the first stage is coupled to the rear frame outside the casing, and wherein the clutch driving portion includes:

a fork lever installed through the second case in a vertical direction and configured to move in the vertical direction by an actuator, a first return spring configured to return the fork lever to an original position, a connecting rod coupled to the fork lever and configured to move in a horizontal direction based on the fork lever moving in the vertical direction, a second return spring configured to return the connecting rod to an original position, and a fork having (i) a first end being coupled to the connecting rod and (ii) a second end being coupled to the dynamic clutch, the fork being configured to rotate based on a pin coupled to the rear frame and adjust a position of the dynamic clutch based on the connecting rod moving in the horizontal direction.

14. The drive system of claim 13, wherein the dynamic clutch further includes a connection portion that connects the first clutch portion with the second clutch portion, wherein a diameter of the connection portion is smaller than diameters of the first clutch portion and the second clutch portion, and wherein the fork is coupled to the connection portion of the dynamic clutch.

15. The drive system of claim 13, wherein the fork lever and the connecting rod each include an inclined portion that allows the connecting rod to move in the horizontal direction based on the fork lever moving in the vertical direction.

16. The drive system of claim 13, wherein a stator is coupled to the rear frame.

17. The drive system of claim 13, wherein the rotor shaft and the output shaft are spaced apart from each other in the horizontal direction.

* * * * *